US010300589B2

(12) United States Patent
Sokol et al.

(10) Patent No.: US 10,300,589 B2
(45) Date of Patent: May 28, 2019

(54) FASTENING TOOL ASSEMBLY

(71) Applicant: Arrow Fastener Co., LLC, Saddle Brook, NJ (US)

(72) Inventors: Jonathan Sokol, New York, NY (US); Stephen Craig Pennington, Chicago, IL (US); Wai Ho Choy, Flushing, NY (US); Michael Reedy, Chicago, IL (US)

(73) Assignee: ARROW FASTENER COMPANY, LLC, Saddle Brook, NJ (US)

( * ) Notice: Subject to any disclaimer, the term of this patent is extended or adjusted under 35 U.S.C. 154(b) by 927 days.

(21) Appl. No.: 13/779,998

(22) Filed: Feb. 28, 2013

(65) Prior Publication Data

US 2013/0228608 A1 Sep. 5, 2013

Related U.S. Application Data

(60) Provisional application No. 61/606,002, filed on Mar. 2, 2012.

(51) Int. Cl.
*B25C 5/11* (2006.01)
*B25C 5/16* (2006.01)

(52) U.S. Cl.
CPC ..... *B25C 5/11* (2013.01); *B25C 5/162* (2013.01); *B25C 5/1696* (2013.01)

(58) Field of Classification Search
CPC ..... B23C 5/10; B25C 5/11; B25C 5/1696
USPC ..... 227/120, 127, 132
See application file for complete search history.

(56) References Cited

U.S. PATENT DOCUMENTS

| | | | |
|---|---|---|---|
| 407,444 | A | 7/1889 | Newman |
| 2,251,833 | A | 8/1941 | Polzer et al. |
| 2,412,620 | A | 12/1946 | Kipp |

(Continued)

FOREIGN PATENT DOCUMENTS

| | | | |
|---|---|---|---|
| GB | 2172539 | A | 9/1986 |
| WO | 2006079785 | A1 | 8/2006 |

OTHER PUBLICATIONS

Extended European Search Report for corresponding Application No. 13275045.6, dated Oct. 24, 2013, 11 pages.

(Continued)

*Primary Examiner* — Gloria R Weeks
*Assistant Examiner* — Patrick B Fry
(74) *Attorney, Agent, or Firm* — Schwabe Williamson & Wyatt, PC

(57) ABSTRACT

A fastening tool assembly has a magazine body in a sleeve to convey fasteners to a housing outlet. Pivoting a lever relative to the housing, translates a knife to a loaded position, thereby disengaging from the knife, permitting a spring to return the knife to an unloaded position to drive a fastener through the outlet. A handle is pivotally connected to the housing. A roller is directly connected to the lever and the handle for permitting translation of the lever relative to the handle as the lever and the handle are pivoted relative to the housing. A spring-loaded bracket is operably connected to the magazine body for translation and rotation relative to the body. A latch is mounted to the housing to engage the bracket and maintain the magazine body in a retracted position, and is movable to a disengaged position wherein the bracket extends from the magazine body.

9 Claims, 8 Drawing Sheets

(56) References Cited

U.S. PATENT DOCUMENTS 3,758,016 A * 9/1973 Olney ..... B25C 1/02 227/132
4,452,388 A * 6/1984 Fealey ..... B25C 5/16 227/120
4,552,296 A * 11/1985 Sheng ..... B25C 5/06 227/109
5,735,444 A * 4/1998 Wingert ..... B25C 5/00 227/119
5,899,374 A * 5/1999 Chen ..... B25C 5/085 227/120
6,145,728 A * 11/2000 Marks ..... B25C 5/11 227/120
6,367,676 B1 * 4/2002 Opland ..... B25C 5/11 227/123
6,698,642 B2 * 3/2004 Chen ..... B25C 5/06 227/120
6,789,719 B2 * 9/2004 Shor ..... B25C 5/11 227/120
7,070,082 B2 * 7/2006 Ronconi ..... B25C 5/1665 227/120
7,464,845 B2 * 12/2008 Chou ..... B25C 5/11 227/127
7,637,407 B2 12/2009 Shor
7,815,089 B2 * 10/2010 Shor ..... B25C 5/10 227/120
8,240,535 B2 * 8/2012 Shor ..... B25C 5/06 227/140
2008/0290133 A1 11/2008 Shor
2009/0072003 A1 3/2009 Matsukawa
2009/0152318 A1 6/2009 Matsukawa

OTHER PUBLICATIONS

U.S. Appl. No. 13/866,561, entitled "Fastening Tool Assembly", filed Apr. 19, 2013, 12 pages.
European Search Report for corresponding European Application No. 13275045.6, dated Jun. 10, 2013, 6 pages.

* cited by examiner

FASTENING TOOL ASSEMBLY

CROSS-REFERENCE TO RELATED APPLICATIONS

This application claims the benefit of U.S. provisional Application No. 61/606,002 filed Mar. 2, 2012, the disclosure of which is incorporated in its entirety by reference herein.

TECHNICAL FIELD

Various embodiments relate to fastening tool assemblies.

BACKGROUND

Prior art fastening tool assemblies that load and release a spring for driving a fastener often employ a lever for loading the spring, and a handle for actuating the lever. The handle is often connected to the lever with a linkage. Prior art fastening tool assemblies often employ a magazine body for retaining fasteners. The magazine body is often retained to a tool housing via a latch mechanism that is mounted upon the magazine body.

SUMMARY

According to at least one embodiment, a fastening tool assembly is provided with a housing having a contact surface to contact a workpiece, and a fastener outlet provided through the contact surface to dispense fasteners from the outlet. A magazine is mounted in the housing to store fasteners and to convey the fasteners to the fastener outlet. A knife is mounted in the housing for translation relative to the outlet for a loaded position and an unloaded position to drive a fastener from the magazine through the outlet during translation to the unloaded position. A biasing member is mounted in the housing and operably connected to the knife to bias the knife to the unloaded position. A lever is pivotally connected to the housing. The lever has a proximal end operably engaged with the knife in the unloaded position, and a distal end extending from the housing. Application of an external force to the distal end towards the housing pivots the lever relative to the housing, thereby translating the knife from the unloaded position to the loaded position, whereby the proximal end disengages from the knife permitting the biasing member to return the knife to the unloaded position to consequently drive a fastener through the outlet. Rotation of the distal end away from the housing reengages the proximal end with the knife. A handle is pivotally connected to the housing and operably engaged with the lever distal end, such that rotation of the handle towards the housing rotates the lever towards the housing. A roller is directly connected to the lever and the handle for permitting translation of the lever relative to the handle as the lever and the handle are pivoted relative to the housing.

According to at least another embodiment, a fastening tool assembly is provided with a housing having a contact surface to contact a workpiece, and a fastener outlet provided through the contact surface to dispense fasteners from the outlet. A magazine sleeve is fixed longitudinally within the housing. A magazine body has a proximal end and a distal end spaced apart from the proximal end. The magazine body is received within the magazine sleeve to translate longitudinally to a retracted position whereby the proximal end is adjacent the housing outlet to store fasteners within the sleeve and to convey the fasteners to the fastener outlet, and to translate to an extended position whereby the body extends at least partially out of the sleeve and external of the housing for receipt of fasteners to the body. A bracket is operably connected to the magazine body distal end for longitudinal translation and partial rotation relative to the body. A biasing member is connected to the bracket and the magazine body for biasing the bracket longitudinally away from the magazine body distal end. A latch is mounted to the housing to engage the bracket in the retracted position of the magazine body to lock the bracket to the housing, and consequently to maintain the magazine body in the retracted position. The latch is movable to a disengaged position wherein the bracket is biased away from the magazine body.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
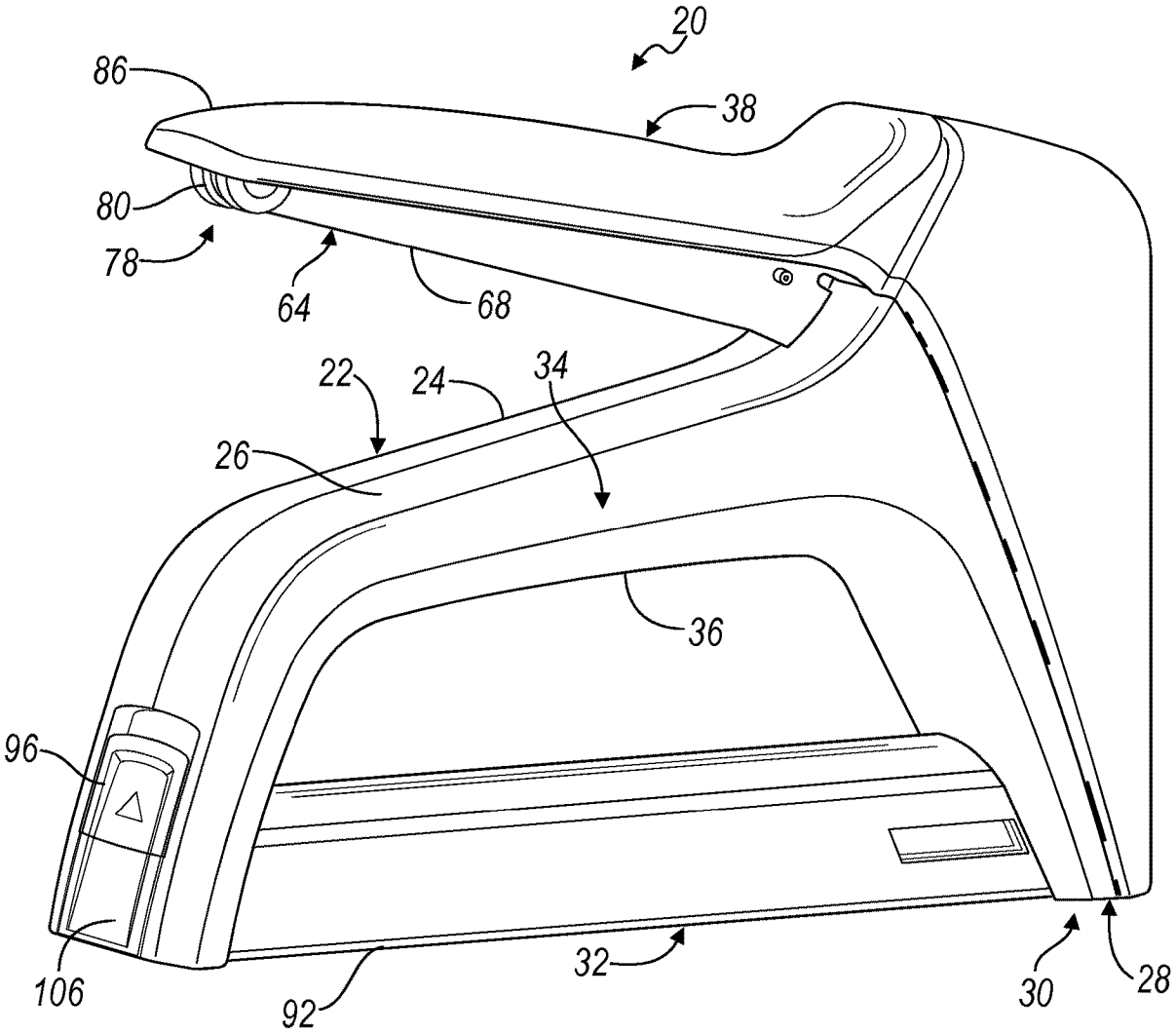
FIG. 1 is a perspective view of a fastening tool assembly according to an embodiment.
Figure 2:
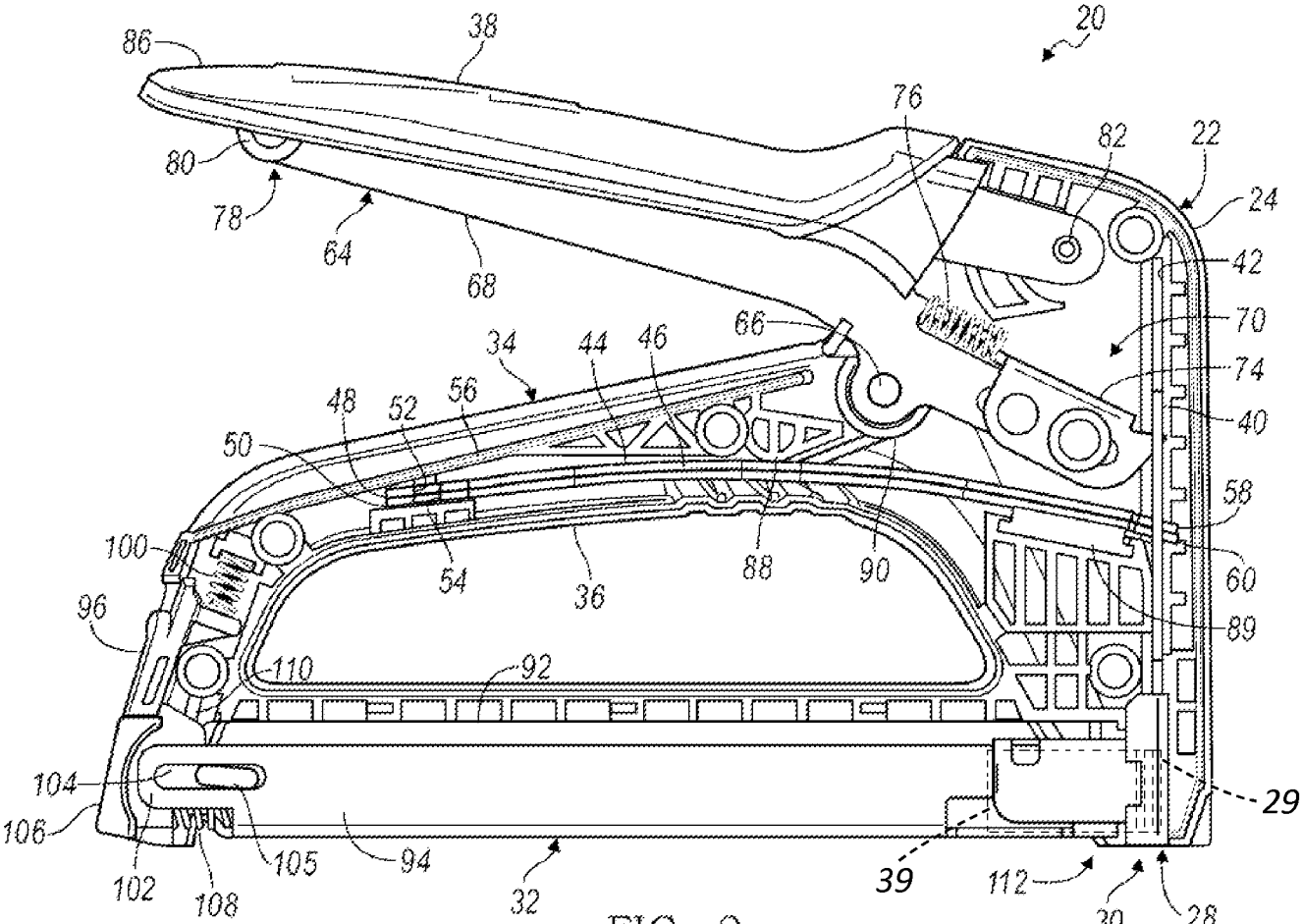
FIG. 2 is a fragmented side view of the fastening tool assembly of FIG. 1.

Referring to FIGS. 1 and 2, a fastening tool, such as a manual staple gun is illustrated and referenced by numeral 20. Although the fastening tool is illustrated and described as a staple gun, the invention contemplates any fastening tool that drives a fastener into a workpiece.

The staple gun 20 has a housing 22, which may be formed from a pair of housing portions 24, 26. The housing 22 has a workpiece contact surface 28 for engaging a workpiece. A fastener outlet 30 is provided through the contact surface 28 for egress of fasteners 29 from the staple gun 20. A magazine assembly 32 is also provided in the housing 22 for storing fasteners 29, and conveying the fasteners 29 to the outlet 30.

The housing 22 also provides a grip 34 spaced apart from the magazine assembly 32 with an opening, or finger well 36, between the grip 34 and the magazine assembly 32, for receipt of a user's fingers when grasping the grip 34. A handle 38 is pivotally connected to the housing 22 for manual actuation for driving a fastener 29 from the outlet 30. In operation, a user inserts her or his fingers into the finger well 36 for contact with the grip 34. The user wraps her or his thumb about the handle 38 so that the user's palm engages the handle 38. By squeezing the grip 34 and handle 38, or by pressing the handle 38 toward the housing 22, the user actuates the staple gun 20 thereby driving a staple out of the staple outlet 30.

According to at least one embodiment, a mid-range staple gun 20 is depicted. In other words, a staple gun 20 is depicted for driving staples of a range of gauges that is in a middle of an entire range of staples that are commercially available. A mid-range staple gun can be marketed for use with mid-range staples only and therefore does not require the driving force of a high-range staple gun, i.e. a staple gun that drives staples of a high range of gauges of staples that are commercially available. By reducing the driving force that is required, a reduction in structure, function, mechanism, and consequently weight and cost can be achieved.

Figure 3:
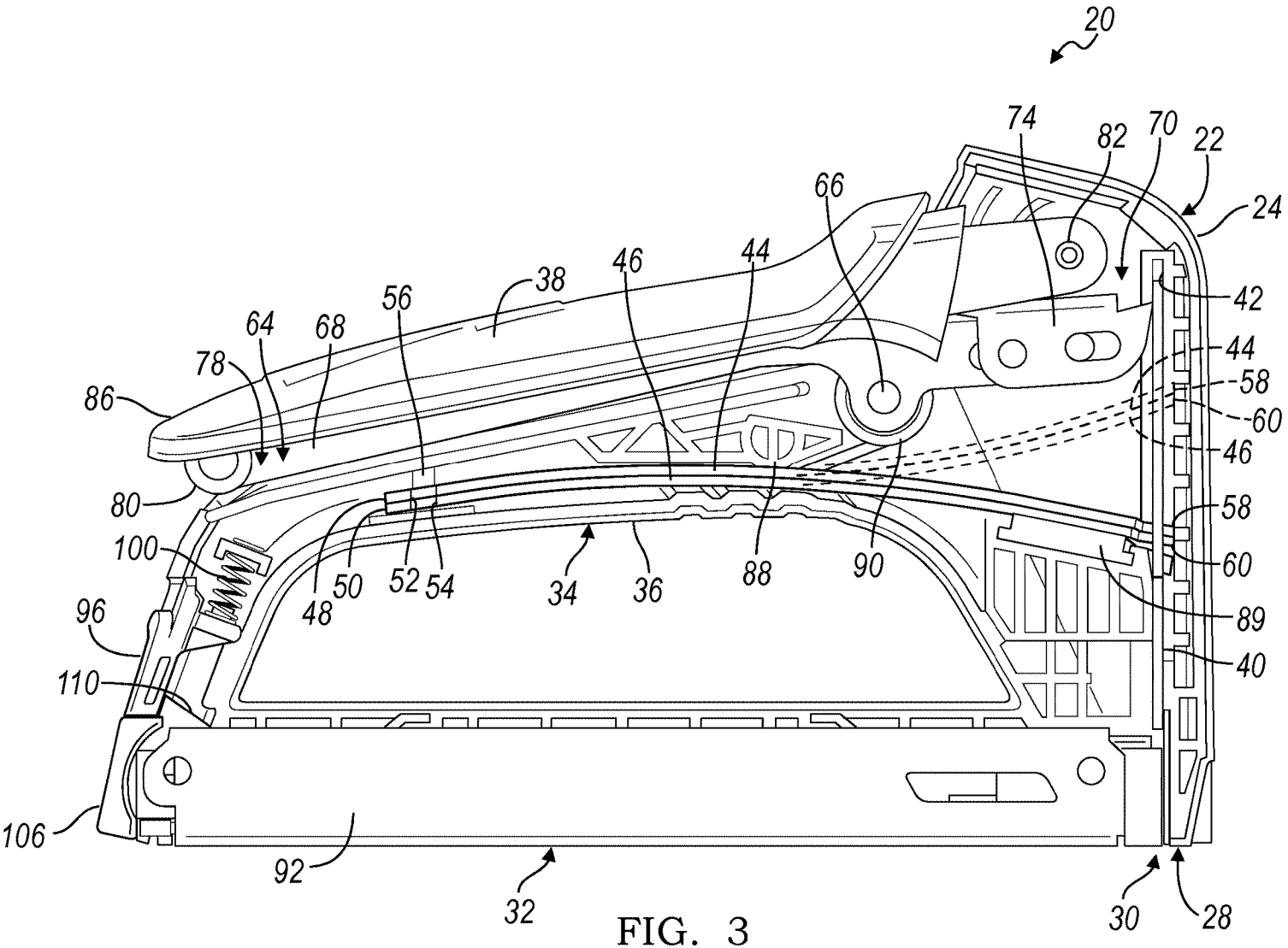
FIG. 3 is another fragmented side view of the fastening tool assembly of FIG. 1, illustrating a handle in a depressed position.

The magazine assembly 32 receives a strip of fasteners 39 that are typically adhered collectively in a linear array by an adhesive. Referring to FIGS. 2 and 3, a driver, commonly referred to as a knife 40, is retained within a slot 42 in the housing 22 for translation between an unloaded position of FIG. 2 and a loaded position of FIG. 3. The slot 42 is aligned with the fastener outlet 30 for driving a fastener 29 from the magazine assembly 32 out of the outlet 30. The knife 40 separates the driven fastener 29 from the fastener strip 39 by applying a shear forceto the driven fastener 29 that separates the adhesive from the driven fastener 29 to the remaining strip 39, and subsequently drives the fastener 29 into the workpiece. Accordingly, the driver is commonly referred to as a knife 40 in the art.

Figure 4:
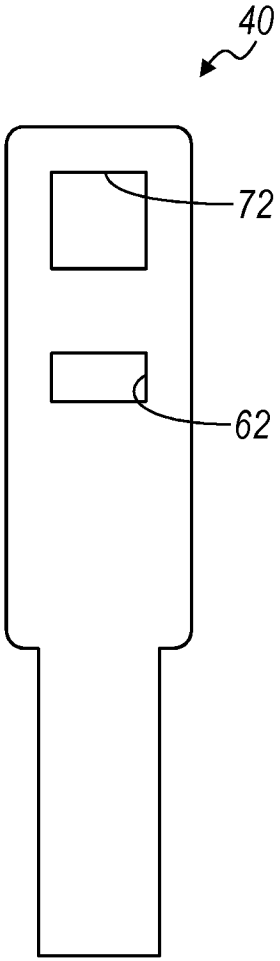
FIG. 4 is an elevation end view of a knife of the fastening tool assembly of FIG. 1.

A biasing member, known as a power spring, is collectively provided by a pair of leaf springs 44, 46, retained in the housing 22. The leaf springs 44, 46 each include a fixed end 48, 50 with a pair of recesses 52, 54 formed therein. Each of the housing portions 24, 26 has a rib 56 formed in the grip 34 for extending into the recesses 52, 54 of the leaf springs 44, 46 for fixing the fixed ends 48, 50 relative to the housing 22. The leaf springs 44, 46 extend from the grip 34 into the slot 42. Driving ends 58, 60 of the leaf springs 44, 46 engage the knife 44 driving the knife 40 to the unloaded position of FIG. 2. Referring to FIG. 4, the knife 40 has an aperture 62 formed therethrough for receiving the driving and 58, 60 of the leaf springs 44, 46. Of course, various power spring arrangements are contemplated, as are known in the art.

Figure 5:
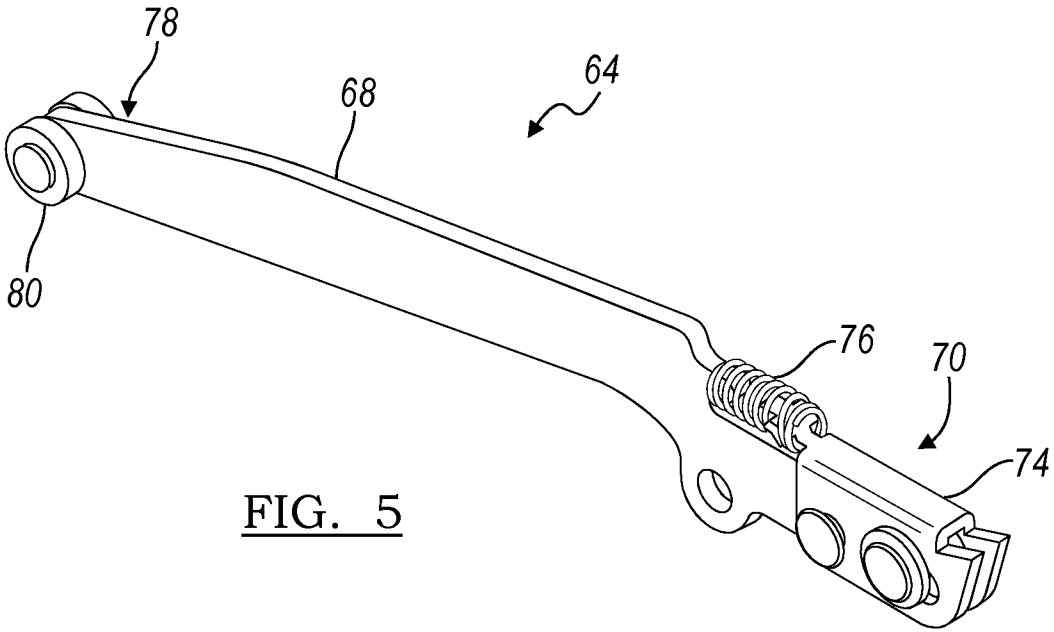
FIG. 5 is a perspective view of a trigger lever assembly of the fastening tool assembly of FIG. 1.

A trigger lever assembly 64 is illustrated pivotally connected to the housing 22 at a pin 66 in FIGS. 2 and 3. The trigger lever assembly 64 is also illustrated removed from the staple gun 20 in FIG. 5. The trigger lever assembly 64 includes a lever 68 that is mounted to the pin 66. A proximal end 70 of the lever 68 may directly engage a trigger aperture 72 (FIG. 4) of the knife 40. As depicted, a trigger slider 74 may be mounted to the proximal end 70 for sliding relative to lever 68 within a limited range. A compression spring 76 is provided on the lever 68, engaging the trigger slider 74 for biasing the trigger slider 74 into engagement with the trigger aperture 72 of the knife 40.

A distal end 78 of the lever 68 extends from the housing 22. A roller assembly 80 is provided on the distal end 78 of the lever 68. FIGS. 2 and 3 illustrates that the handle 38 is pivotally connected to the housing 22 at a pin 82 that is spaced apart from the pin 66 for the trigger lever assembly 64.

Figure 6:
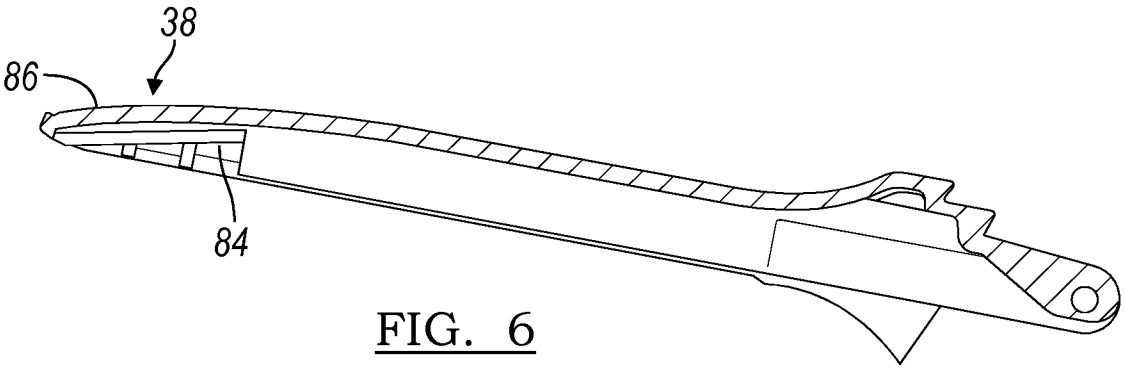
FIG. 6 is a section view of the handle of the fastening tool assembly of FIG. 1.
Figure 7:
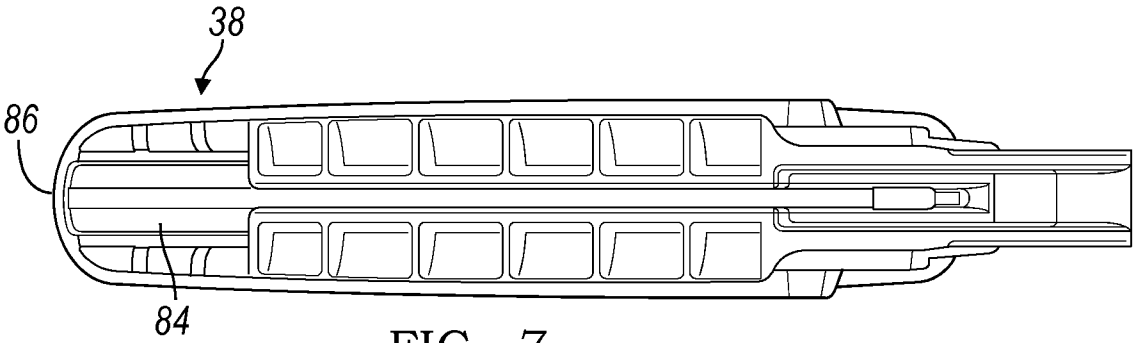
FIG. 7 is a bottom plan view of the handle of the fastening tool assembly of FIG. 1.

Referring now to FIGS. 6 and 7, a follower path 84 is formed underneath the handle 38 for engagement with the roller assembly 80. Thus, as the user pivots the handle 38 toward the grip 34 of the housing 22, the roller assembly 80 rolls along the follower path 84 thereby minimizing friction between the handle 38 and the lever 68. By providing a rolling connection between the handle 38 and the lever 68, a mechanical advantage is provided at the initial actuation of the handle 38, wherein much displacement of the driving ends 58, 60, and consequently, much deflection of the leaf springs 44, 46 occurs. As the handle 38 becomes fully pivoted, as illustrated in FIG. 3, the roller assembly 80 is received near a distal end 86 of the handle 38 wherein less spring deflection per rotation occurs and consequently less mechanical advantage is employed. Although the roller assembly 80 is illustrated on the lever 68, with a ramp or follower path 84 on the handle 38, the invention contemplates providing a roller assembly upon the handle 38 for engagement with a ramp or follower path upon the lever 68 according to at least one embodiment. By providing the roller assembly 80 in direct connection between the lever 68 and the handle 38, an additional link or linkage is eliminated in comparison to the prior art.

A fastener driving operation is now described with reference to FIGS. 2 and 3. Manual rotation of the handle 38 toward the grip 34 from FIG. 2 to FIG. 3, consequently rotates the trigger lever assembly 64 from the position of FIG. 2 to FIG. 3. The trigger slider 74 raises the knife 40 upward within the slot 42 to the loaded position of FIG. 3. By removal of the knife 40 from a region of the slot 42 adjacent the magazine assembly 32, the magazine assembly 32 actuates the fastener strip 39 into the slot 42. As the knife 40 is raised in FIG. 3, the leaf springs 44, 46 are deflected against a fulcrum 88 in the housing to a loaded position illustrated in phantom in FIG. 3. Once the handle 38 is fully depressed, the lever 68 is rotated to a position whereby the trigger slider 74 is retracted out of the trigger aperture 72 as illustrated in FIG. 3. The release of the trigger slider 74 from the trigger aperture 72 of the knife 40 causes the leaf springs 44, 46 to drive the knife 40 toward the fastener outlet 30. The knife 40 strikes a leading fastener 29 on the fastener strip 39 and drives the fastener 29 from the outlet 30. A bumper 89 is provided in the housing 22 for damping an impact from the leaf springs 44, 46 to the housing 22.

A torsion spring 90 is provided in the housing 22 and engages the housing 22 and the lever 68 for returning the lever 68 into engagement with the knife 40. Thus, once the user releases the force upon the handle 38, the torsion spring 90 pivots the lever 68 from the position in FIG. 3 to the position in FIG. 2. Consequently, the rotation of the lever 68 from the position of FIG. 3 to the position of FIG. 2 also returns the handle 38 to the extended position of FIG. 2. As the lever 68 rotates away from the grip 34, the trigger slider 74 engages the knife 40. The trigger slider 74 retracts upon the lever 68 until alignment with the trigger aperture 72 whereby the compression spring 76 extends the trigger slider 74 into the trigger aperture 72 thereby re-engaging the trigger lever assembly 64 with the knife 40.

Figure 8:
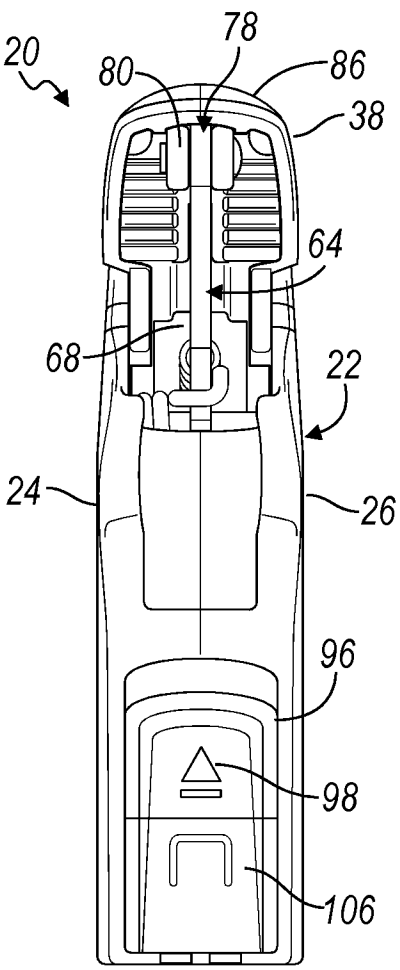
FIG. 8 is an elevation back end view of the fastening tool assembly of FIG. 1.

Referring again to FIGS. 1-3, the magazine assembly 32 includes a magazine sleeve 92 that is fixed longitudinally to the housing 22. A magazine body 94 is received within the sleeve 92 to translate longitudinally for extension from the housing 22 for reloading of fasteners 29 to the magazine body 94. The prior art has provided various mechanisms for unlatching the magazine body 94 from the magazine sleeve 92. In order to increase the ease for unlatching the magazine body 94, an intuitive latch switch 96 is provided on the housing 22 spaced apart from the outlet 30. The latch switch 96 is mounted to the housing 22 to slide relative to the housing 22. See FIGS. 1-3, and also FIG. 8. Indicia 98 (FIG. 8) may be provided upon the latch switch 96 to inform the user of a direction to actuate the switch 96 to the position depicted in FIG. 9, for accessing the magazine body 94. A coil spring 100 is provided between the latch switch 96 and the housing 22 to bias the latch switch 96 into engagement with the magazine body 94.

Figure 10:
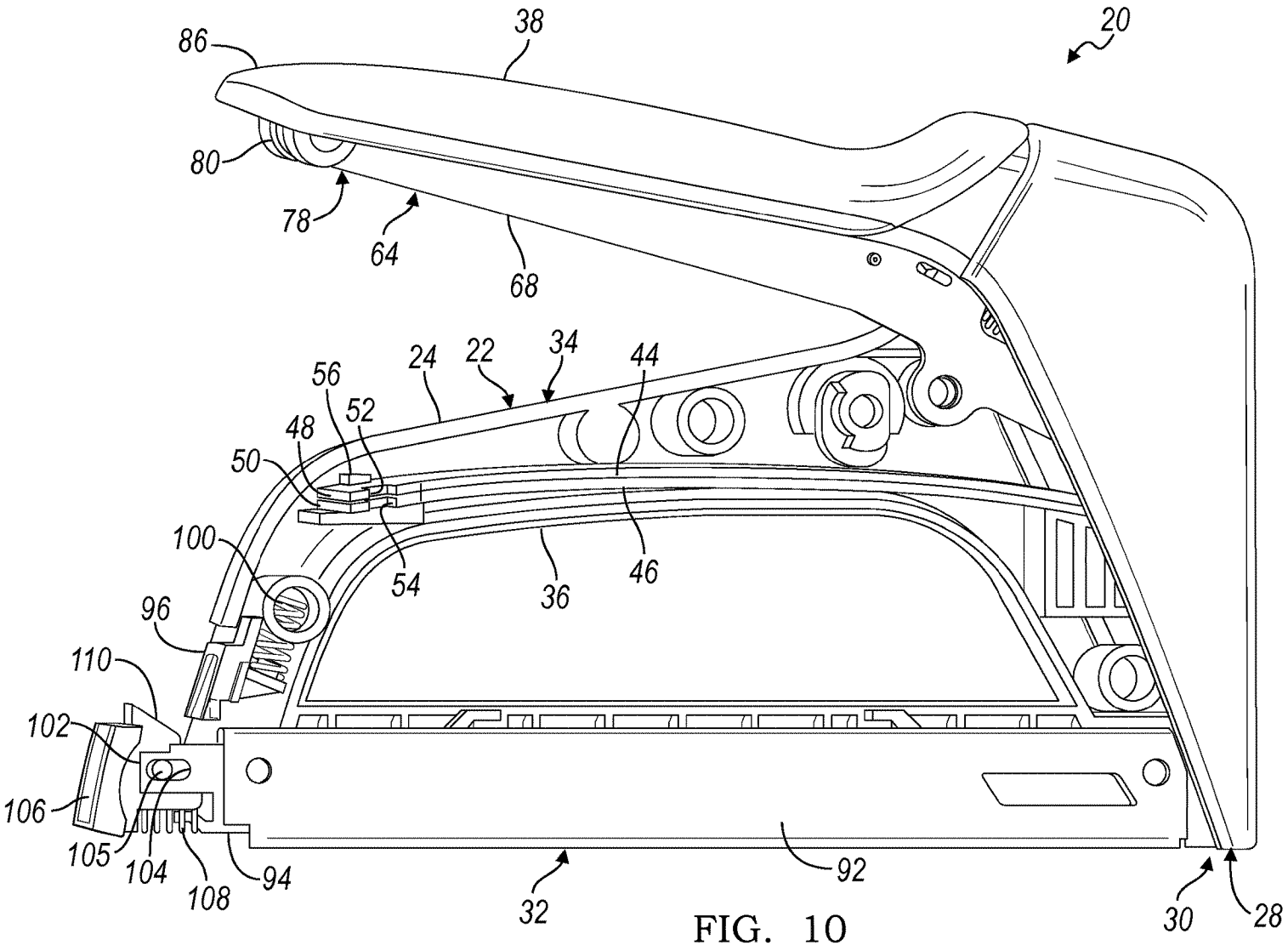
FIG. 10 is another fragmented perspective view of the fastening tool assembly of FIG. 1, illustrating a magazine body partially extended.
Figure 11:
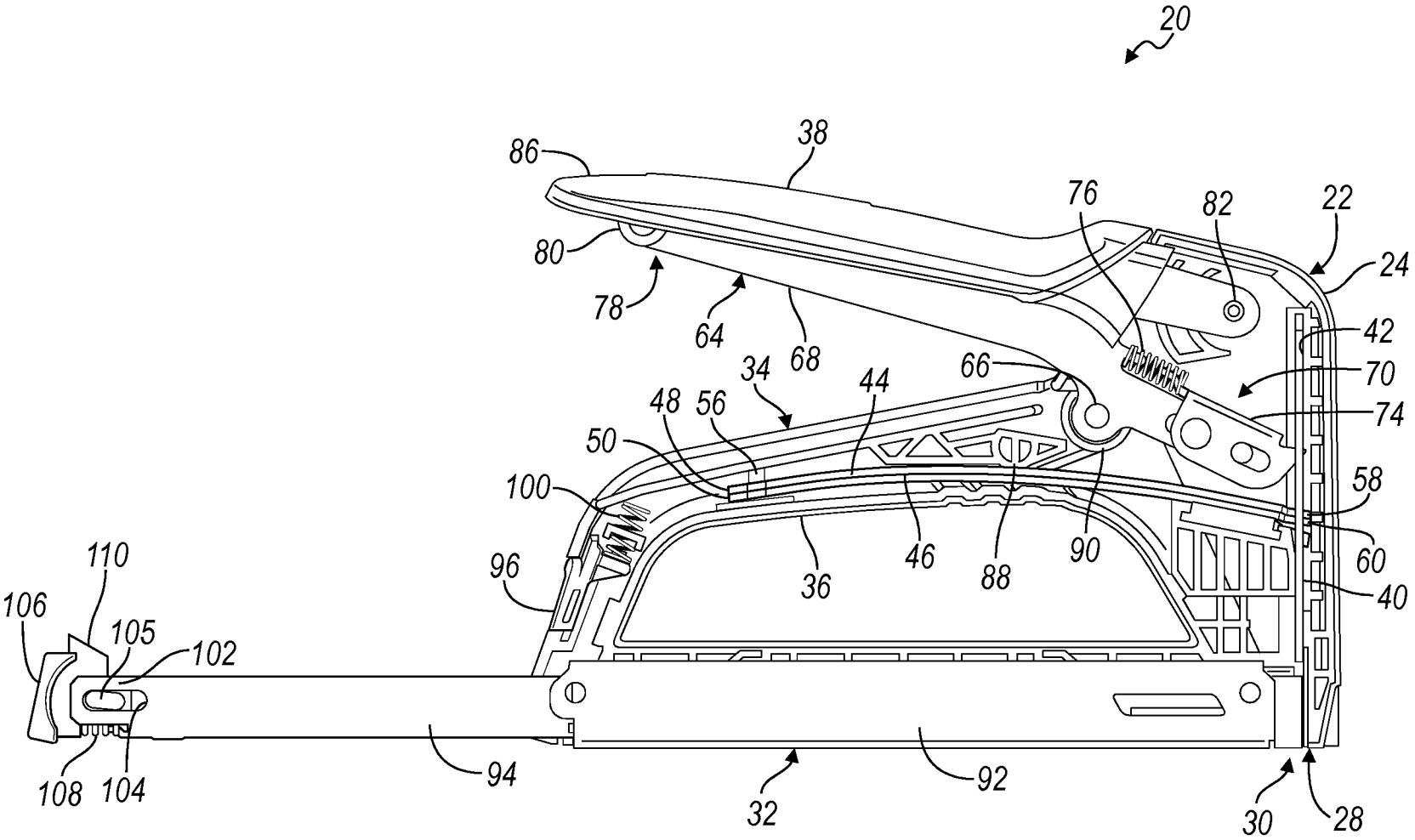
FIG. 11 is a fragmented side view of the fastening tool assembly of FIG. 1, illustrating the magazine body fully extended.

Referring to FIGS. 2, 10 and 11, a distal end 102 of the magazine body 94 has a longitudinal slot 104 formed therethrough. A bracket 106 is pivotally connected to the magazine body 94 by a slider 105 within the slot 104. A coil spring 108 is provided between the bracket 106 and the magazine body 94 for biasing the bracket 106 longitudinally away from the distal end 102 of the magazine body 94.

Figure 9:
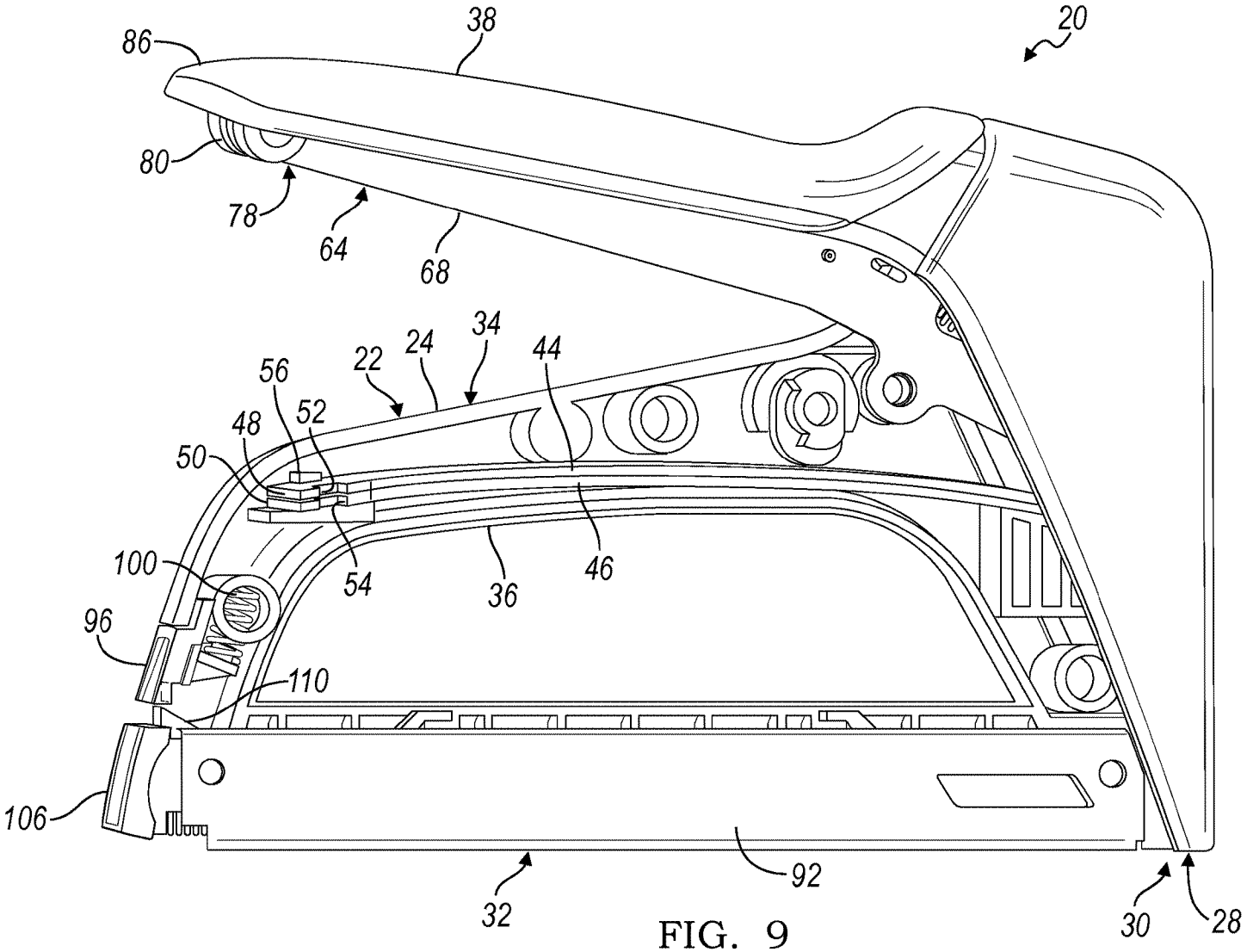
FIG. 9 is a fragmented perspective view of the fastening tool assembly of FIG. 1 illustrating a latch in an unlocked position.

Once the latch switch 96 is slid out of engagement from the bracket 106 as illustrated in FIG. 9, the coil spring 108 extends the bracket 106 from the magazine body 94 as depicted in FIG. 10. At this position, the bracket 106 is more readily accessible for grasping by the user for extending the magazine body 94 from the housing 22 is illustrated in FIG. 11. Additionally, by permitting the coil spring 108 to extend the bracket 106 in the position illustrated in FIG. 10, it is more readily apparent to the user how to access the magazine body 94.

In the extended position of FIG. 11, the user places another strip of fasteners 29 upon or within the magazine body 94. To reload the magazine assembly 32, the user presses the bracket 106 toward the housing 22. The bracket 106 includes a leading-edge 110 that upon engagement with the latch which 96 urges the latch switch 96 upward as illustrated in FIG. 9. Once the leading-edge 110 is pressed past the latch switch 96, the latch switch 96 retracts to the latched position illustrated in FIGS. 1-3 and 8. Referring again to FIGS. 2 and 3, a proximal end 112 of the magazine body 94 is presented adjacent to the knife slot 42 for delivering a leading fastener 29 to be driven by the knife 40 out of the outlet 30.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fastening tool assembly comprising:

a housing having a contact surface to contact a workpiece, and a fastener outlet provided through the contact surface to dispense fasteners from the outlet;

a magazine sleeve fixed longitudinally within the housing;

a magazine body having a proximal end and a distal end spaced apart from the proximal end, the magazine body being received within the magazine sleeve to translate longitudinally to a retracted position whereby the proximal end is adjacent the fastener outlet to store fasteners within the sleeve and to convey the fasteners to the fastener outlet, and to translate to an extended position whereby the body extends at least partially out of the sleeve and external of the housing for receipt of fasteners to the body;

a bracket operably connected to the magazine body distal end for longitudinal translation and partial rotation relative to the body;

a biasing member connected to the bracket and the magazine body for biasing the bracket longitudinally away from the magazine body distal end; and a latch mounted to the housing to engage the bracket in the retracted position of the magazine body to lock the bracket to the housing, and consequently to maintain the magazine body in the retracted position, wherein the latch is movable to a disengaged position such that the bracket is biased away from the magazine body;

wherein the biasing member is further defined as a first biasing member; and wherein the fastening tool assembly further comprises a second biasing member cooperating with the latch and the housing to bias the latch into engagement with the bracket.

2. The fastening tool assembly of claim 1 further comprising indicia provided upon the latch to indicate a direction to actuate the latch to access the magazine body.

3. The fastening tool assembly of claim 1 wherein actuation of the latch out of engagement from the bracket causes the first biasing member to extend the bracket from the magazine body for external access for manual gripping of the bracket.

4. The fastening tool assembly of claim 3 wherein the bracket includes a leading edge to engage the latch and retract the latch as the bracket is translated into the housing so that as the bracket is translated past the latch, the latch extends into engagement with the bracket thereby retaining the bracket.

5. A fastening tool assembly comprising:

a housing having a first end and a second end, with a contact surface extending from the first end to the second end to contact a workpiece, and a fastener outlet provided at the first end of the housing, through the contact surface to dispense fasteners from the outlet;

a magazine sleeve fixed longitudinally within the housing;

a magazine body having a proximal end and a distal end spaced apart from the proximal end, the magazine body being received within the magazine sleeve to translate longitudinally to a retracted position whereby the proximal end is adjacent the housing outlet to store fasteners within the sleeve and to convey the fasteners to the fastener outlet, and to translate to an extended position whereby the body extends at least partially out of the sleeve and external of the housing for receipt of fasteners to the body;

a bracket operably connected to the magazine body distal end for longitudinal translation and partial rotation relative to the body;

a biasing member connected to the bracket and the magazine body for biasing the bracket longitudinally away from the magazine body distal end;

a latch mounted to the housing to engage the bracket in the retracted position of the magazine body to lock the bracket to the housing, and consequently to maintain the magazine body in the retracted position, wherein the latch is movable to a disengaged position wherein the bracket is biased away from the magazine body;

a knife mounted in the housing for translation relative to the outlet for a loaded position and an unloaded position to drive a fastener from the magazine body through the outlet during translation to the unloaded position;

a biasing member mounted in the housing and operably connected to the knife to bias the knife to the unloaded position;

a lever pivotally connected proximate to the first end of the housing spaced apart from the contact surface, the lever having a proximal end operably engaged with the knife in the unloaded position, and a distal end extending from the housing, so that application of an external force to the lever distal end towards the housing pivots the lever relative to the housing, thereby translating the knife from the unloaded position to the loaded position, whereby the lever proximal end disengages from the knife permitting the biasing member to return the knife to the unloaded position to consequently drive a fastener through the outlet, wherein rotation of lever distal end away from the housing reengages the lever proximal end with the knife;

a handle pivotally connected to the first end of the housing and operably engaged with the lever distal end, such that rotation of the handle towards the housing rotates the lever towards the housing; and a roller directly connected to the lever and the handle for permitting translation of the lever relative to the handle as the lever and the handle are pivoted relative to the housing;

wherein the roller is pivotally connected to the lever;

wherein the handle includes a follower path formed underneath the handle for engagement with the roller;

wherein the follower path is formed underneath the handle at a distal end of the handle;

wherein the biasing member is further defined as a first biasing member; and wherein the fastening tool assembly further comprises a second biasing member cooperating with the latch and the housing to bias the latch into engagement with the bracket.

6. The fastening tool assembly of claim 5 wherein the engagement of the roller and follower path provides a mechanical advantage at initial actuation of the handle.

7. The fastening tool assembly of claim 5 further comprising indicia provided upon the latch to indicate a direction to actuate the latch to access the magazine body.

8. The fastening tool assembly of claim 5 wherein actuation of the latch out of engagement from the bracket causes the first biasing member to extend the bracket from the magazine body for external access for manual gripping of the bracket.

9. The fastening tool assembly of claim 5 wherein the roller engages the follower path at the distal end of the handle when the handle and the lever are pivoted toward the housing until the knife reaches the unloaded position.

* * * * *